US010807155B2

(12) United States Patent
Izumi

(10) Patent No.: US 10,807,155 B2
(45) Date of Patent: Oct. 20, 2020

(54) MOLDING METHOD OF CORE AND MOLDING DEVICE OF CORE

(71) Applicant: TOYOTA JIDOSHA KABUSHIKI KAISHA, Toyota-shi, Aichi-ken (JP)

(72) Inventor: Shogo Izumi, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 182 days.

(21) Appl. No.: 16/184,158

(22) Filed: Nov. 8, 2018

(65) Prior Publication Data

US 2019/0184452 A1 Jun. 20, 2019

(30) Foreign Application Priority Data

Dec. 14, 2017 (JP) ..... 2017-239355

(51) Int. Cl.

| | |
|---|---|
| ***B22C 19/00*** | (2006.01) |
| ***B22C 9/12*** | (2006.01) |
| ***B22C 9/10*** | (2006.01) |
| ***B22C 13/12*** | (2006.01) |

(52) U.S. Cl.

CPC ..... *B22C 19/00* (2013.01); *B22C 9/10* (2013.01); *B22C 9/12* (2013.01); *B22C 13/12* (2013.01)

(58) Field of Classification Search

None

See application file for complete search history.

(56) References Cited

U.S. PATENT DOCUMENTS

| | | | | |
|---|---|---|---|---|
| 300,480 | A | 6/1884 | Kinzer | |
| 3,631,918 | A * | 1/1972 | Barrett | B22C 7/065 164/410 |
| 2009/0236070 | A1* | 9/2009 | Ide | B22C 15/24 164/526 |
| 2012/0217373 | A1* | 8/2012 | Ide | B22C 1/2253 249/117 |
| 2015/0083356 | A1* | 3/2015 | Longa | B22C 9/106 164/15 |
| 2019/0283119 | A1* | 9/2019 | Okumura | B22C 13/16 |

FOREIGN PATENT DOCUMENTS

JP H07-299544 A 11/1995

* cited by examiner

*Primary Examiner* — Mary Lynn F Theisen

(74) *Attorney, Agent, or Firm* — Oliff PLC

(57) ABSTRACT

A core molding method capable of satisfactorily exhausting a gaseous body such as gas or water vapor that is generated inside an outer shell layer when a raw material is cured is provided. A core molding method according to one aspect of the present disclosure is a molding method of a core formed of a raw material including a binder and sand, and includes: filling a cavity of a molding die with the raw material; curing the raw material to form an outer shell layer; inserting a tip end part of an exhaust pipe having an internal pin inserted therein and an exhaust hole closed by the internal pin into a part surrounded by the outer shell layer through an opening provided in the molding die; and moving the internal pin and opening the exhaust hole.

3 Claims, 5 Drawing Sheets

MOLDING METHOD OF CORE AND MOLDING DEVICE OF CORE

CROSS REFERENCE TO RELATED APPLICATIONS

This application is based upon and claims the benefit of priority from Japanese patent application No. 2017-239355, filed on Dec. 14, 2017, the disclosure of which is incorporated herein in its entirety by reference.

BACKGROUND

The present disclosure relates to a molding method of a core and a molding device of a core.

In general, a core that is used when it is casted is molded by filling a molding die with a raw material including a binder such as resin or water glass and sand. Japanese Unexamined Patent Application Publication No. H07-299544 discloses a core releasing device including a flange part, a gas vent pin protruded from a substantial center of the flange part, and an extrusion pin inserted into an opening formed in a base part of the gas vent pin in the flange part. This releasing device is provided in the molding die in such a way that the gas vent pin is protruded into a cavity of the molding die, and when the cavity is filled with the raw material, the tip end part of the gas vent pin reaches a part inside the packed raw material.

SUMMARY

The present applicant has found the following problem. While an outer shell layer is formed on the entire circumferential surface of the raw material when the raw material is cured, since the gas vent pin of the releasing device disclosed in Japanese Unexamined Patent Application Publication No. H07-299544 is inserted into the raw material before the outer shell layer is formed, the gas vent pin is arranged outside the outer shell layer when the outer shell layer is formed, and it is thus difficult to satisfactorily exhaust the gaseous body such as gas or water vapor generated in a part surrounded by the outer shell layer (that is, inside the outer shell layer).

The present disclosure has been made in view of the aforementioned problem and provides a molding method of a core and a molding device of a core capable of satisfactorily exhausting the gaseous body such as gas or water vapor generated inside the outer shell layer when the raw material is cured.

A molding method of a core according to one aspect of the present disclosure is a molding method of a core formed of a raw material including a binder and sand, the method including:

filling a cavity of a molding die with the raw material;

curing the raw material to form an outer shell layer;

inserting a tip end part of an exhaust pipe having an internal pin inserted therein and an exhaust hole closed by the internal pin into a part surrounded by the outer shell layer through an opening provided in the molding die; and moving the internal pin and opening the exhaust hole.

Accordingly, the exhaust pipe is inserted into the outer shell layer formed by curing the raw material, the opening is formed in the outer shell layer, and the gaseous body that is generated inside the outer shell layer when the raw material is cured can be satisfactorily exhausted from the opening to the outside of the molding die through the exhaust pipe.

In the aforementioned molding method of the core, at an early stage of the formation of the outer shell layer, which is shortly after the outer shell layer is formed on the entire circumferential surface of the raw material, the tip end part of the exhaust pipe whose exhaust hole is closed by the internal pin is preferably inserted into the part surrounded by the outer shell layer.

Accordingly, the core can be unmolded in a short period of time after the start of the curing of the raw material, as a result of which a core molding cycle can be reduced.

A molding device of a core according to one aspect of the present disclosure is a molding device of a core formed of a raw material including a binder and sand, the device including:

a molding die in which the raw material is filled; and an exhaust mechanism configured to exhaust a gaseous body generated in a part surrounded by an outer shell layer formed by curing the raw material, in which the exhaust mechanism includes:

an exhaust pipe capable of inserting a tip end part into a cavity of the molding die and removing the tip end part from the cavity to an outside of the cavity through an opening formed in the molding die; and an internal pin that is movable inside the exhaust pipe in order to open or close an exhaust hole formed inside the exhaust pipe.

Accordingly, the exhaust mechanism is inserted into the outer shell layer formed by curing the raw material, the opening is formed in the outer shell layer, and the gaseous body that is generated inside the outer shell layer when the raw material is cured can be satisfactorily exhausted from the opening to the outside of the molding die through the exhaust mechanism.

According to the present disclosure, it is possible to obtain the molding method of the core and the molding device of the core capable of satisfactorily exhausting the gaseous body such as gas or water vapor that is generated inside the outer shell layer when the raw material is cured.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Hereinafter, with reference to the drawings, a specific embodiment to which the present disclosure is applied will be explained in detail. However, this disclosure is not limited to the following embodiment. Further, for the sake of clarification of the explanation, the following descriptions and the drawings are simplified as appropriate.

Figure 1:
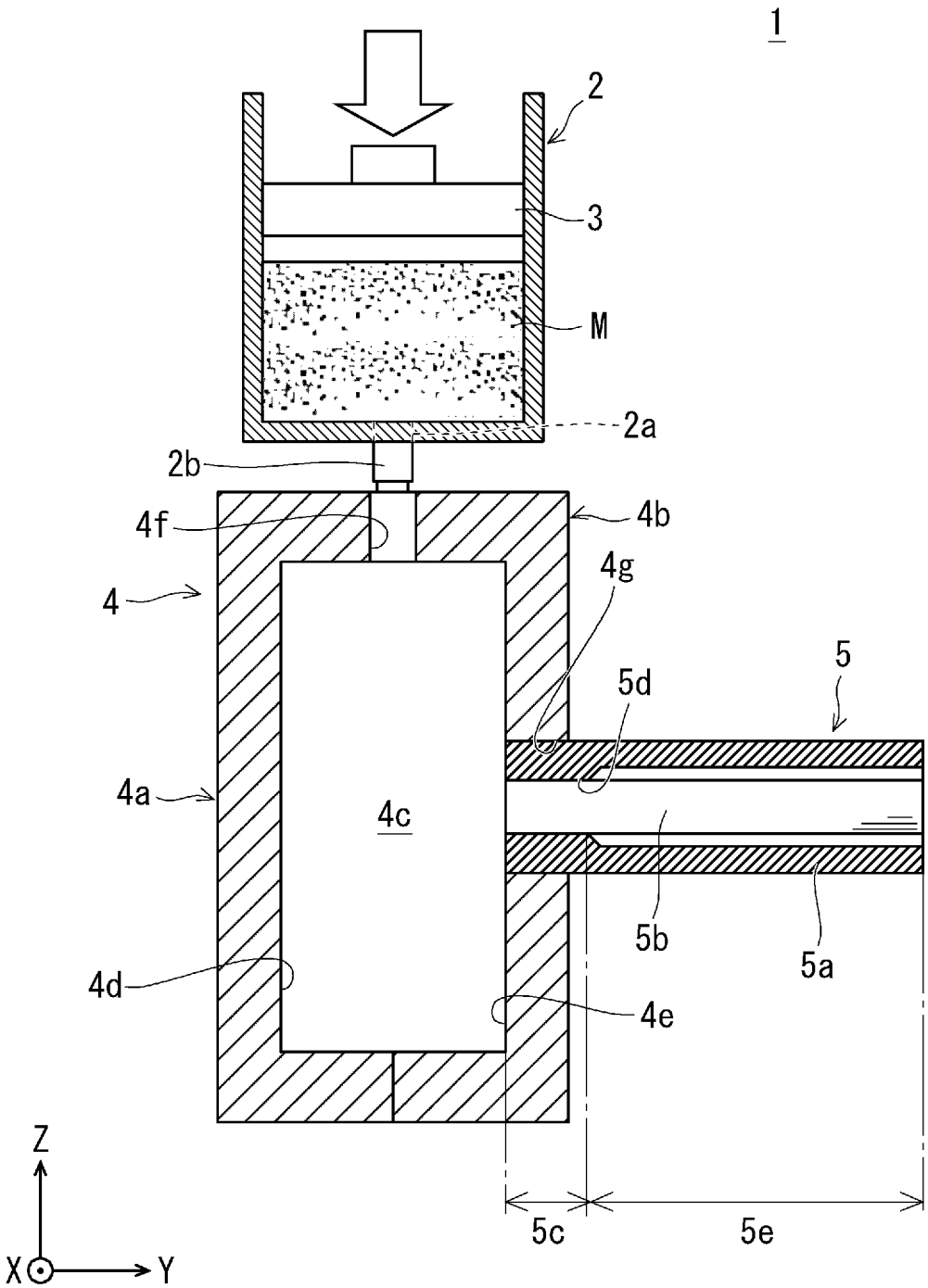
FIG. 1 is a partial cross-sectional view schematically showing a core molding device according to an embodiment.

First, a structure of a core molding device according to this embodiment (hereinafter this device may be simply referred to as a molding device) will be explained. FIG. 1 is a partial cross-sectional view schematically showing the core molding device according to this embodiment. In the following description, for the sake of clarity of the description, a three-dimensional (XYZ) coordinate system will be used for the description.

A molding device 1 according to this embodiment is suitably used when the core is molded from a raw material including a hinder such as resin or water glass and sand, and includes an injection cylinder 2, an injection piston 3, a molding die 4, and an exhaust mechanism 5 as shown in FIG. 1. The core to be molded is not limited to an inorganic core and may be an organic core. Further, the binder is not limited to resin or water glass, and may be a binder that is used in general.

For example, a raw material M in which the binder and the sand are kneaded is injected into the injection cylinder 2. The injection cylinder 2 has, for example, a bottomed cylindrical body as its basic form, and includes an opening 2*a* in a bottom part thereof arranged on the Z-axis negative side. The injection cylinder 2 includes a lead-out pipe 2*b* connected to the opening 2*a*.

The injection piston 3 can be moved in the Z-axis direction inside the injection cylinder 2 based on a drive force of a first drive source (not shown), and extrudes the raw material M injected into the injection cylinder 2 to the molding die 4 through the lead-out pipe 2*b*.

The molding die 4 is arranged on the Z-axis negative side of the injection cylinder 2, and includes a first mold 4*a* and a second mold 4*b*. The first mold 4*a* and the second mold 4*b* are relatively made to come close to each other in the Y-axis direction and closed together, whereby a cavity 4*c* is formed inside the molding die 4. However, the arrangement of the molding die 4 can be changed as appropriate in accordance with, for example, the direction in which the raw material M is extruded from the injection cylinder 2.

That is, when the first mold 4*a* and the second mold 4*b* are closed in a state in which a recessed part 4*d* formed in the first mold 4*a* faces a recessed part 4*e* formed in the second mold 4*b* in the Y-axis direction, the cavity 4*c* is formed by the recessed part 4*d* of the first mold 4*a* and the recessed part 4*e* of the second mold 4*b*. The cavity 4*c* is formed to have a shape that corresponds to the core to be molded.

The molding die 4 includes a first opening 4*f* to allow the raw material M to be packed into the cavity 4*e*. The first opening 4*f* is formed to penetrate through the molding die 4 in a part of the molding die 4 on the Z-axis positive side, the end part of the first opening 4*f* on the Z-axis negative side reaches the cavity 4*c*, and the end part of the first opening 4*f* on the Z-axis positive side reaches the outside of the molding die 4. The first opening 4*f* is connected to the lead-out pipe 2*b* of the injection cylinder 2.

Accordingly, the raw material M extruded by the injection piston 3 is packed into the cavity 4*c* through the lead-out pipe 2*b* of the injection cylinder 2 and the first opening 4*f*. While the first opening 4*f* is formed in such a way as to straddle the first mold 4*a* and the second mold 4*b* in the state in which the first mold 4*a* and the second mold 4*b* are closed together in FIG. 1, it may be formed either in the first mold 4*a* or in the second mold 4*b*.

The exhaust mechanism 5, the details of which will be explained later, exhausts a gaseous body such as gas or water vapor generated in a part surrounded by an outer shell layer formed by curing the raw material M (that is, inside the outer shell layer). The exhaust mechanism 5 includes an exhaust pipe 5*a* and an internal pin 5*b*.

The exhaust pipe 5*a* is extended in, for example, the Y-axis direction, and the end part of the exhaust pipe 5*a* on the Y-axis negative side is inserted into a second opening 4*g* formed in the second mold 4*b* in such a way that it penetrates through the second mold 4*b* in the Y-axis direction. The exhaust pipe 5*a* has a cylindrical body in which an outer shape substantially the same as the XZ cross-sectional shape of the second opening 4*g* of the molding die 4 is continuous in the Y-axis direction as its basic form. The XZ cross-sectional area of the end part inside the exhaust pipe 5*a* on the Y-axis negative side is reduced, and the part inside a reduced small-diameter part 5*c* is an exhaust hole 5*d*.

The aforementioned exhaust pipe 5*a* moves in the axis direction (that is, Y-axis direction) of the exhaust pipe 5*a* based on a drive force of a second drive source (not shown), and the end part of the exhaust pipe 5*a* on the Y-axis negative side can be inserted into the cavity 4*c* and can be removed from the cavity 4*c* to an outside of the cavity 4*c*, The shape and the arrangement of the exhaust pipe 5*a* are not limited to those stated above as long as it can be inserted into and removed from the cavity 4*c* of the molding die 4. The arrangement of the second opening 4*g* formed in the molding die 4 is changed as appropriate in accordance with the arrangement of the exhaust pipe 5*a*.

The internal pin 5*b* opens or closes the exhaust hole 5*d* of the exhaust pipe 5*a*. The internal pin 5*b* has, for example, a rod-shaped body extending in the Y-axis direction, and the XZ cross-sectional shape substantially the same as the XZ cross-sectional shape of the exhaust hole 5*d* of the exhaust pipe 5*a* is continuous in the Y-axis direction.

The aforementioned internal pin 5*b* moves in the axial direction (that is, the Y-axis direction) of the internal pin 5*b* inside the exhaust pipe 5*a* based on a drive force of a third drive source (not shown). The shape and the arrangement of the internal pin 5*b* are changed as appropriate in accordance with the XZ cross-sectional shape of the exhaust hole 5*d* of the exhaust pipe 5*a* and the arrangement of the exhaust pipe 5*a*.

Figure 2:
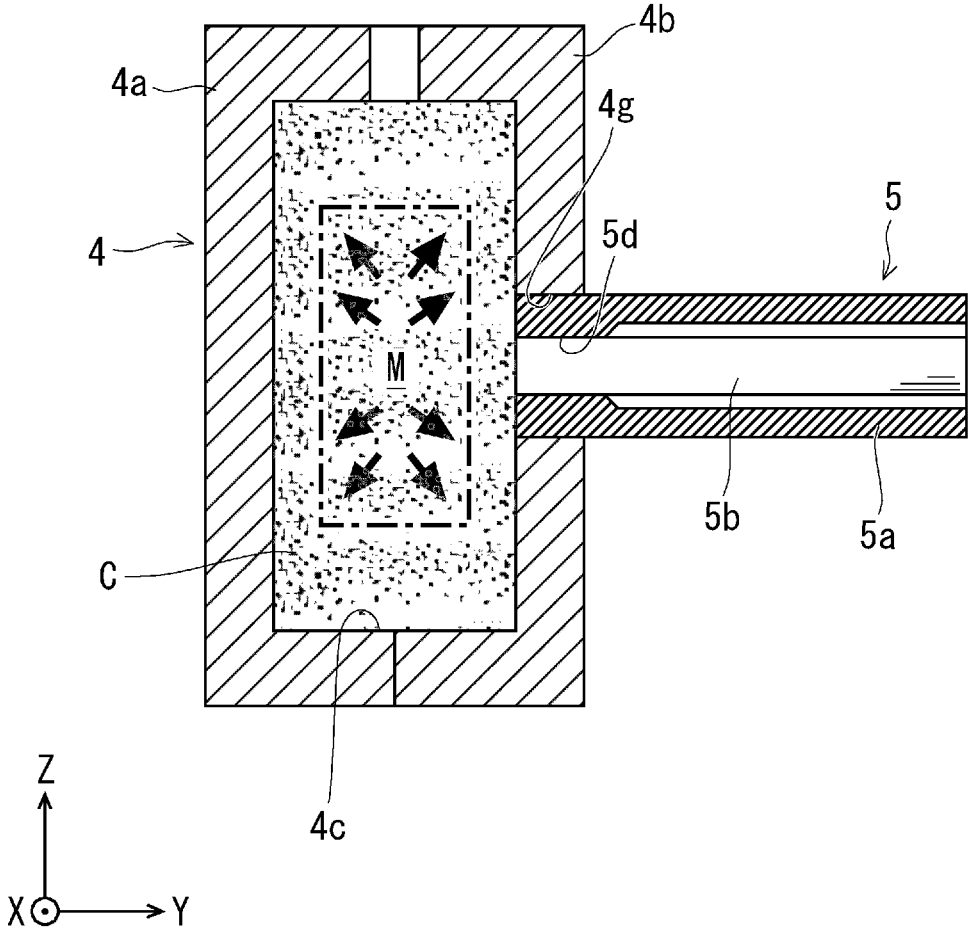
FIG. 2 is partial cross-sectional view schematically showing an early stage of formation of an outer shell layer by curing a raw material packed into a cavity of a molding die.
Figure 3:
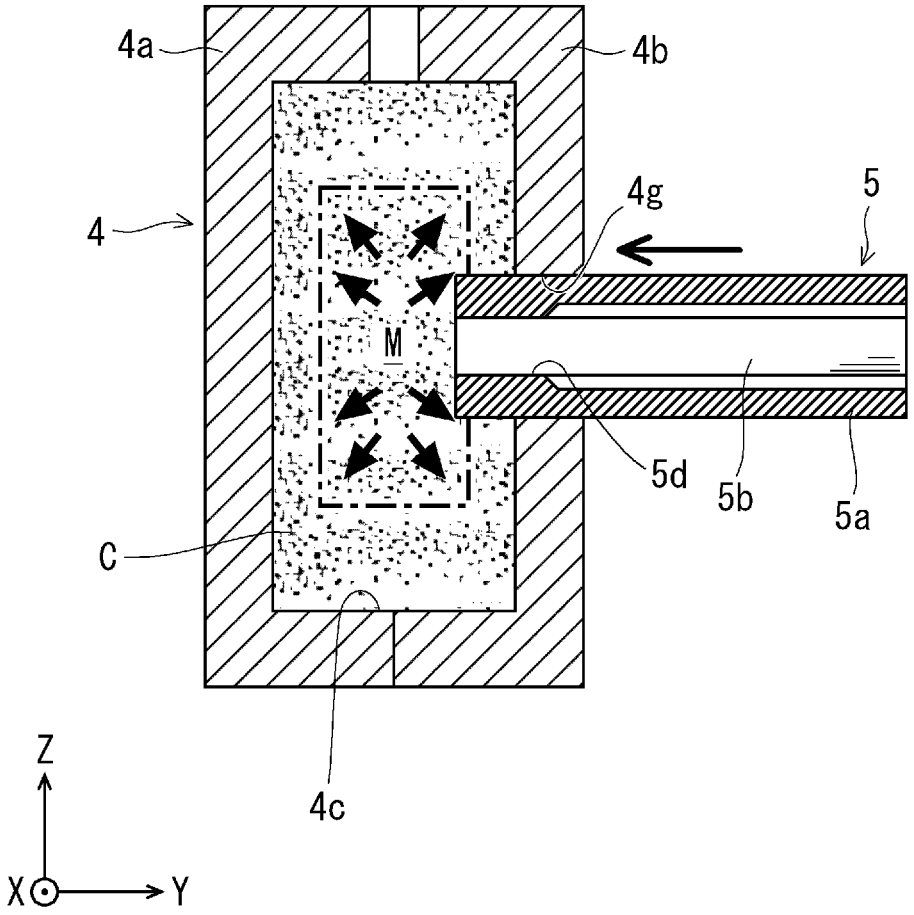
FIG. 3 is a partial cross-sectional view schematically showing a state in which an exhaust mechanism is inserted into the outer shell layer.
Figure 4:
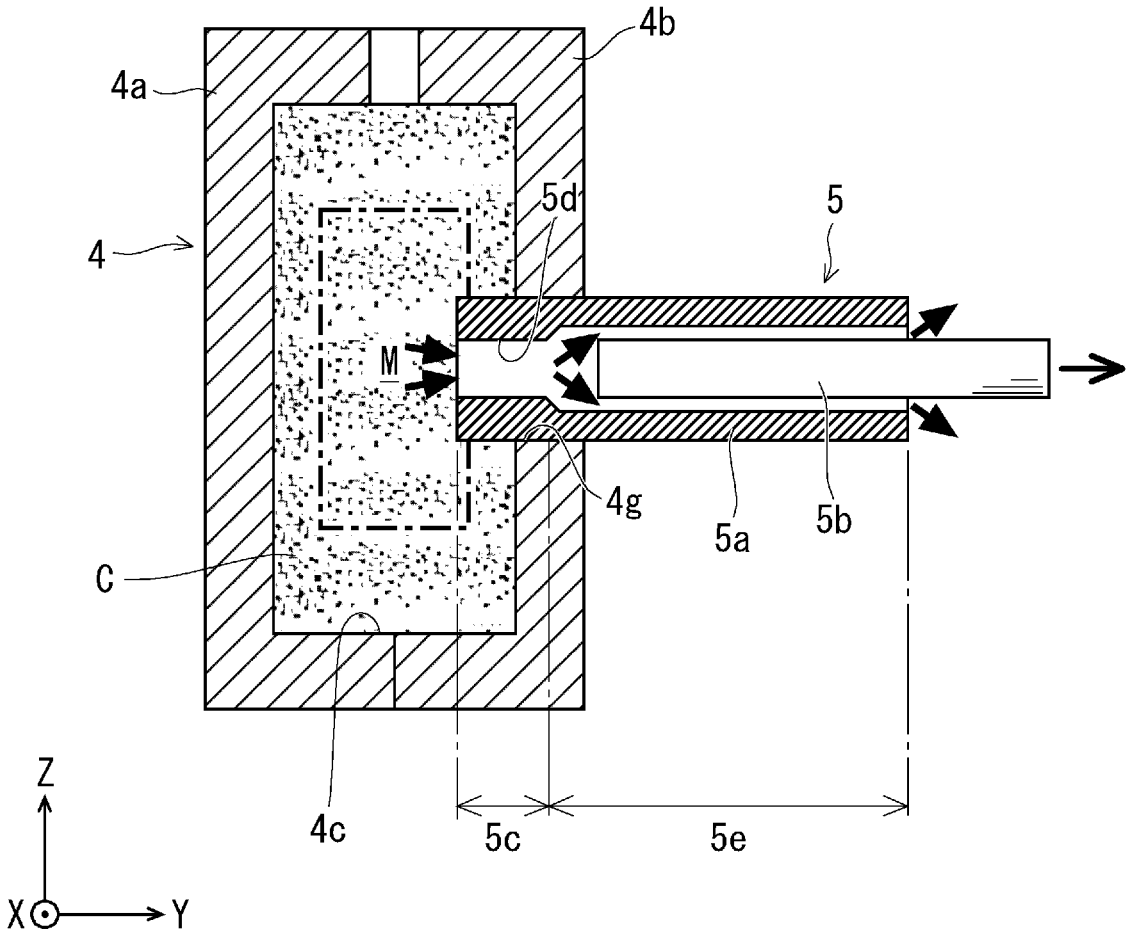
FIG. 4 is a partial cross-sectional view schematically showing a state in which a gaseous body generated inside the outer shell layer is exhausted from an exhaust pipe.

Next, a core molding method using the aforementioned molding device 1 will be explained. FIG. 2 is a partial cross-sectional view schematically showing an early stage of the formation of the outer shell layer by curing the raw material packed into the cavity of the molding die. FIG. 3 is a partial cross-sectional view schematically showing a state in which the exhaust mechanism is inserted into the outer shell layer. FIG. 4 is a partial cross-sectional view schematically showing a state in which the gaseous body generated inside the outer shell layer is exhausted from the exhaust pipe. FIGS. 2 to 4, in order to simplify the drawings, the injection cylinder 2 and the injection piston 3 are not shown.

In the initial state, the first mold 4*a* and the second mold 4*b* are closed together and the end surface of the exhaust pipe 5*a* on the Y-axis negative side and the end surface of the internal pin 5*b* on the Y-axis negative side are arranged in such a way that they are substantially flush with the recessed part 4*e* of the second mold 4*b*. That is, in this state, the exhaust hole 5*d* of the exhaust pipe 5*a* is blocked by the internal pin 5*b*. Further, the second opening 4*g* of the second mold 4*b* is blocked by the exhaust pipe 5*a* and the internal pin 5*b*.

In this state, the injection piston 3 is moved in the Z-axis negative direction to extrude the raw material M from the injection cylinder 2, and this raw material M is packed into the cavity 4*c* through the lead-out pipe 2*b* and the first opening 4*f*.

Then the first mold 4*a* and the second mold 4*b* are heated. Then, as shown in FIG. 2, an outer shell layer C is formed on the circumferential surface of the raw material M. After that, the outer shell layer C is formed on the entire circumferential surface of the raw material M. At this time, in the uncured part of the raw material M inside the outer shell layer C, the gaseous body such as gas or water vapor is generated and the gaseous body that has been generated is confined inside the outer shell layer C. Therefore, the internal pressure of the outer shell layer C increases.

While the boundary between the outer shell layer C and the uncured part of the raw material M is shown by an alternate long and short dash line in each of FIGS. 2-4, in reality, the boundary between the outer shell layer C and the uncured part of the raw material M is not clear, and the volume of the outer shell layer C with respect to the uncured part of the raw material M roughly increases from an internal part of the packed raw material M to an external part thereof.

Next, at the early stage of the formation of the outer shell layer C, which is shortly after the outer shell layer C is formed on the entire circumferential surface of the raw material M, as shown in FIG. 3, the exhaust pipe 5*a* and the internal pin 5*b* are moved in the Y-axis negative direction, that is, the exhaust pipe 5*a* that is in a state in which the exhaust hole 5*d* is blocked by the internal pin 5*b* is moved in the Y-axis negative direction, thereby causing the end parts of the exhaust pipe 5*a* and the internal pin 5*b* on the Y-axis negative side to be inserted into the outer shell layer C. Accordingly, the opening is formed in the outer shell layer C.

Next, as shown in FIG. 4, the internal pin 5*b* is moved in the Y-axis positive direction to open the exhaust hole 5*d* of the exhaust pipe 5*a*. Accordingly, the gaseous body generated inside the outer shell layer C is exhausted from the exhaust pipe 5*a* to the outside of the molding die 4. At this time, when the internal pin 5*b* is removed from the exhaust hole 5*d* of the exhaust pipe 5*a*, the gaseous body can be satisfactorily exhausted from the clearance between the inner circumferential surface of a large-diameter part 5*e* that is widened internally with respect to the small-diameter part 5*c* of the exhaust pipe 5*a* and the circumferential surface of the internal pin 5*b* through the exhaust hole 5*d* of the exhaust pipe 5*a*.

After that, when the curing of the raw material M proceeds, the core molding is ended. When the first mold 4*a* and the second mold 4*b* are relatively spaced apart from each other in the Y-axis direction, the core that has been molded can be unmolded.

As described above, according to the core molding method and the core molding device 1 according to this embodiment, the exhaust mechanism 5 is inserted into the outer shell layer C formed by curing the raw material M, the opening is formed in the outer shell layer C, and the gaseous body generated inside the outer shell layer C when the raw material M is cured can be satisfactorily exhausted from the opening to the outside of the molding die 4 through the exhaust mechanism 5.

Further, in this embodiment, in the initial state, the end surface of the exhaust pipe 5*a* on the Y-axis negative side and the end surface of the internal pin 5*b* on the Y-axis negative side are arranged in such a way that they are substantially flush with the recessed part 4*e* of the second mold 4*b*. Therefore, the outer shell layer C is formed along the recessed part 4*e* of the second mold 4*b* and the amount of the movement of the exhaust pipe 5*a* and the internal pin 5*b* with respect to the second mold 4*b* can be made small. This can contribute to a reduction in size of the molding device 1.

In addition, the exhaust mechanism 5 is inserted into the outer shell layer C in a state in which the exhaust hole 5*d* of the exhaust pipe 5*a* is closed by the internal pin 5*b*, whereby it is possible to prevent the raw material M from getting stuck in the exhaust hole 5*d* of the exhaust pipe 5*a*.

If the internal pressure of the outer shell layer C is higher than the strength of the outer shell layer C, the core is deformed when the core that has been molded is unmolded. Therefore, the core that has been molded cannot be unmolded unless the internal pressure of the outer shell layer C becomes lower than the strength of the outer shell layer C.

Figure 5:
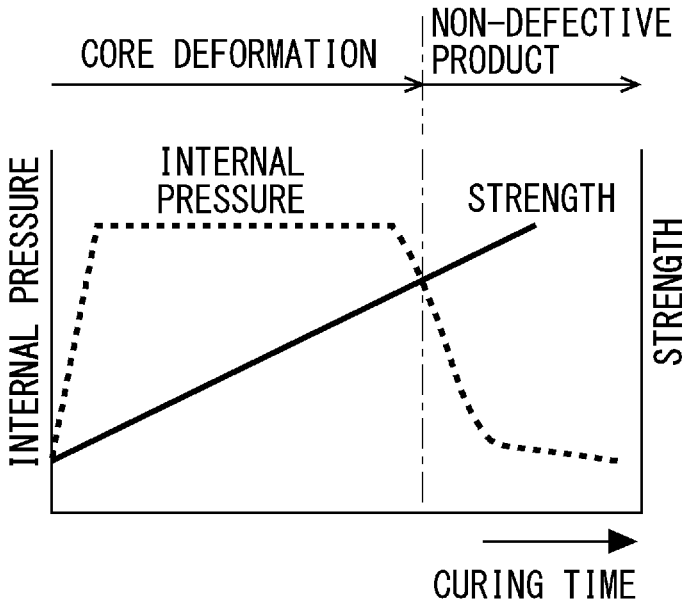
FIG. 5 is a diagram showing a relation between an internal pressure of the outer shell layer and a strength of the outer shell layer when the core is molded without exhausting the gaseous body that is generated inside the outer shell layer.
Figure 6:
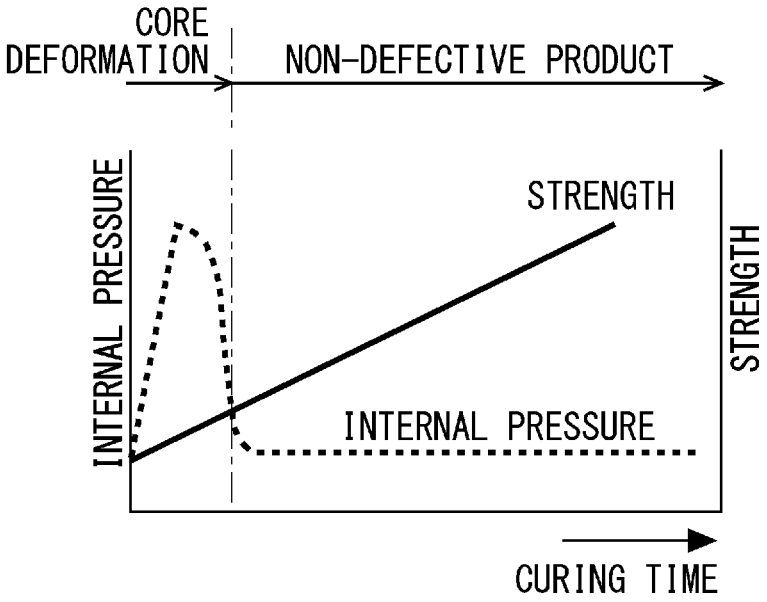
FIG. 6 is a diagram showing a relation between the internal pressure of the outer shell layer and the strength of the outer shell layer when the core is molded by a core molding method according to this embodiment.

FIG. 5 is a diagram showing a relation between the internal pressure of the outer shell layer and the strength of the outer shell layer when the core is molded without exhausting the gaseous body that is generated inside the outer shell layer. FIG. 6 is a diagram showing a relation between the internal pressure of the outer shell layer and the strength of the outer shell layer when the core is molded in the core molding method according to this embodiment.

In each of FIGS. 5 and 6, the internal pressure of the outer shell layer is shown by a dashed line and the strength of the outer shell layer is shown by a solid line. Further, FIGS. 5 and 6 each show the boundary between the time after the curing of the raw material M has started in which the core is deformed when it is unmolded and the time after the curing of the raw material M has started in which the core is not substantially deformed when it is unmolded (that is, a non-defective product can be obtained) by an alternate long and short dash line.

When the core is molded without exhausting the gaseous body generated inside the outer shell layer C, as shown in FIG. 5, as the curing time of the raw material M passes and the outer shell layer C is formed, the internal pressure of the outer shell layer C increases, and after that the gaseous body generated inside the outer shell layer C is leaked out from a small clearance in the outer shell layer C, which causes the internal pressure of the outer shell layer C to be reduced. On the other hand, in accordance with an increase in the curing time of the raw material M, the thickness of the outer shell layer C increases and the strength of the outer shell layer C increases. Since the amount of the gaseous body generated inside the outer shell layer C being leaked out from the small clearance of the outer shell layer C is quite small, the core needs to be unmolded after the strength of the outer shell layer C increases.

On the other hand, when the core is molded by the core molding method according to this embodiment, as shown in FIG. 6, the internal pressure of the outer shell layer C increases as the curing time of the raw material M passes and the outer shell layer C is formed. However, since the exhaust mechanism 5 is inserted inside the outer shell layer C at the early stage of the formation of the outer shell layer C, exhaust of the gaseous body generated inside the outer shell layer C may be started at an early stage after the outer shell layer C is formed.

Accordingly, when the core is molded by the core molding method according to this embodiment, compared to the case in which the core is molded without exhausting the gaseous body generated inside the outer shell layer C, the internal pressure of the outer shell layer C can be made smaller than the strength of the outer shell layer C in a short period of time after the start of the curing of the raw material M. Accordingly, when the core is molded by the core molding method according to this embodiment, compared to the case in which the core is molded without exhausting the gaseous body generated inside the outer shell layer C, the core can be unmolded in a short period of time after the start of the curing of the raw material M, as a result of which it becomes possible to reduce a core molding cycle.

The present disclosure is not limited to the aforementioned embodiment and may be changed as appropriate without departing from the spirit of the present disclosure.

While the exhaust pipe 5*a* and the internal pin 5*b* are inserted into the outer shell layer C at the early stage of the formation of the outer shell layer C in the aforementioned embodiment, the timing when the exhaust pipe 5*a* and the internal pin 5*b* are inserted into the outer shell layer C is not particularly limited. It is sufficient that the exhaust pipe 5*a* and the internal pin 5*b* be inserted into the outer shell layer C after the outer shell layer C is formed in a substantially overall area of the circumferential surface of the raw material M.

While the gaseous body is exhausted from the clearance between the inner circumferential surface of the large-diameter part 5*e* of the exhaust pipe 5*a* and the circumferential surface of the internal pin 5*b* by moving the internal pin 5*b* in the aforementioned embodiment, the gaseous body may be exhausted by removing the internal pin 5*b* from the exhaust pipe 5*a*.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A molding method of a core formed of a raw material including a binder and sand, the method comprising the steps of:

filling a cavity of a molding die with the raw material;

curing the raw material to form an outer shell layer;

inserting a tip end part of an exhaust pipe having an internal pin inserted therein and an exhaust hole closed by the internal pin into a part surrounded by the outer shell layer through an opening provided in the molding die; and moving the internal pin and opening the exhaust hole.

2. The molding method of the core according to claim 1, wherein, at an early stage of the formation of the outer shell layer, which is shortly after the outer shell layer is formed on the entire circumferential surface of the raw material, the tip end part of the exhaust pipe whose exhaust hole is closed by the internal pin is inserted into the part surrounded by the outer shell layer.

3. A molding device of a core formed of a raw material including a binder and sand, the device comprising:

a molding die in which the raw material is filled; and an exhaust mechanism configured to exhaust a gaseous body generated in a part surrounded by an outer shell layer formed by curing the raw material, wherein the exhaust mechanism comprises:

an exhaust pipe capable of inserting a tip end part into a cavity of the molding die and removing the tip end part from the cavity to an outside of the cavity through an opening formed in the molding die; and an internal pin that is movable inside the exhaust pipe in order to open or close an exhaust hole formed inside the exhaust pipe.

* * * * *